US009359803B1

(12) United States Patent
Strawser et al.

(10) Patent No.: US 9,359,803 B1
(45) Date of Patent: Jun. 7, 2016

(54) DOOR FOR LASER ENGRAVING DEVICE

(71) Applicant: TYKMA, Inc., Chillicothe, OH (US)

(72) Inventors: John T Strawser, Circleville, OH (US); David M Grimes, Chillicothe, OH (US)

(73) Assignee: Tykma, Inc., Chillicothe, OH (US)

( * ) Notice: Subject to any disclaimer, the term of this patent is extended or adjusted under 35 U.S.C. 154(b) by 0 days.

(21) Appl. No.: 14/835,840

(22) Filed: Aug. 26, 2015

Related U.S. Application Data

(60) Provisional application No. 62/046,198, filed on Sep. 5, 2014.

(51) Int. Cl.

| | |
|---|---|
| ***E05F 15/50*** | (2015.01) |
| ***E05F 15/41*** | (2015.01) |
| ***E05F 15/42*** | (2015.01) |
| ***E05F 15/665*** | (2015.01) |
| ***E05F 15/70*** | (2015.01) |

(52) U.S. Cl.
CPC ..... *E05F 15/41* (2015.01); *E05F 15/42* (2015.01); *E05F 15/665* (2015.01); *E05F 15/70* (2015.01)

(58) Field of Classification Search
CPC ..... E05F 1/02; E05F 1/04; E05F 1/16; E05F 15/50; E05F 15/57; E05F 15/665; E05F 15/40; E05F 15/41; E05F 15/42
USPC ..... 49/26–28, 360
See application file for complete search history.

(56) References Cited

U.S. PATENT DOCUMENTS

| | | | | |
|---|---|---|---|---|
| 546,854 | A * | 9/1895 | Holbrook | E05F 15/665 49/361 |
| 3,714,737 | A * | 2/1973 | Fillion | E05F 15/57 49/139 |
| 3,755,967 | A * | 9/1973 | Nourse | E05F 15/57 49/360 |
| 4,624,512 | A * | 11/1986 | Fay | F26B 25/12 312/292 |
| 4,677,718 | A * | 7/1987 | Babel | B23Q 11/08 29/33 P |
| 5,566,508 | A * | 10/1996 | Houston | E05D 13/14 49/360 |
| 5,595,026 | A * | 1/1997 | Licking | E05B 51/02 49/280 |
| 5,971,679 | A * | 10/1999 | Kim | B23Q 11/08 408/241 G |
| 7,121,042 | B2 * | 10/2006 | Robert | E05D 15/20 49/209 |
| 7,162,835 | B1 * | 1/2007 | Manpuku | E05F 15/57 49/116 |
| 7,744,035 | B2 * | 6/2010 | Saint-Jalmes | B64D 11/003 244/118.5 |
| 2004/0093801 | A1 * | 5/2004 | Robert | E05D 15/20 49/360 |
| 2015/0267456 | A1 * | 9/2015 | Shih | E05F 15/643 49/349 |

* cited by examiner

*Primary Examiner* — Katherine Mitchell
*Assistant Examiner* — Justin Rephann
(74) *Attorney, Agent, or Firm* — Theresa Camoriano; Guillermo Camoriano; Duncan Galloway Egan Greenwald, PLLC

(57) ABSTRACT

A powered mechanism to open and close a door to a housing for a laser engraving device, with an arrangement that allows the powered mechanism to separate from the door so that the powered mechanism does not exert any force on any obstacle that the door may encounter when closing.

6 Claims, 4 Drawing Sheets

DOOR FOR LASER ENGRAVING DEVICE

This application claims priority from U.S. Provisional application Ser. 62/046,198 filed Sep. 5, 2014.

BACKGROUND

The present invention relates to an automatic door for an enclosure for a laser engraving device.

Many automatic doors for laser engraving device enclosures are very complicated and require sophisticated safety mechanisms to prevent the door from crushing anything that might become caught beneath the door when it is closing, such as a person's hand.

SUMMARY

An embodiment of the present invention provides a powered door closing mechanism which automatically separates from the door if an obstacle is encountered during the closing operation. This prevents the powered door closing mechanism from exerting force on the obstacle.

DESCRIPTION

Figure 1:
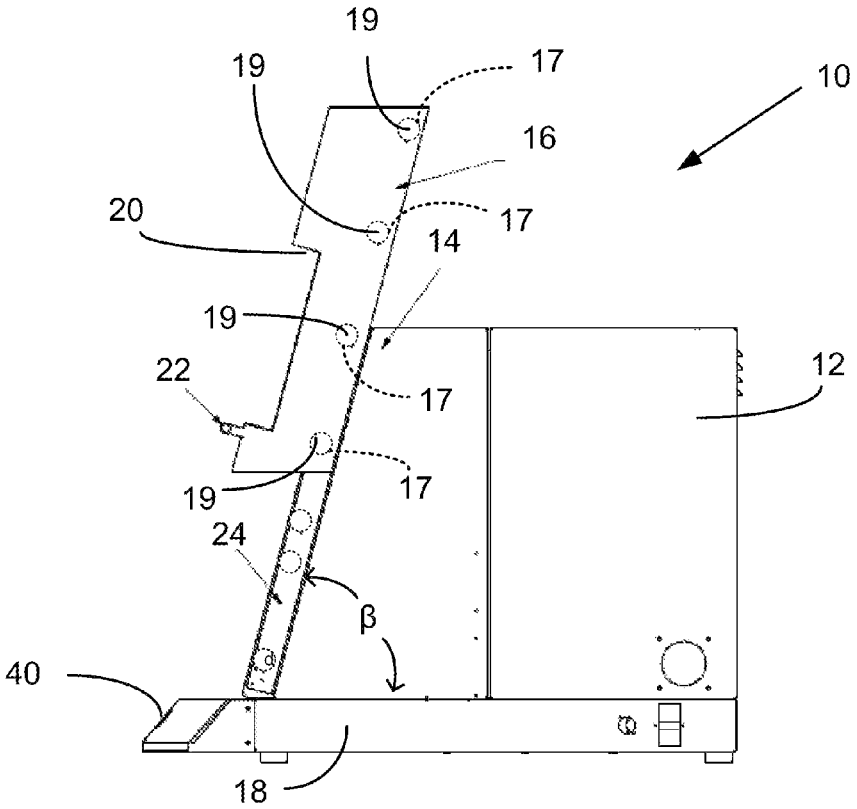
FIG. 1 is a side view of an embodiment of a laser engraving device having a door made in accordance with the present invention, with the manual door portion shown in the open position and the automatic door in the closed position.
Figure 2:
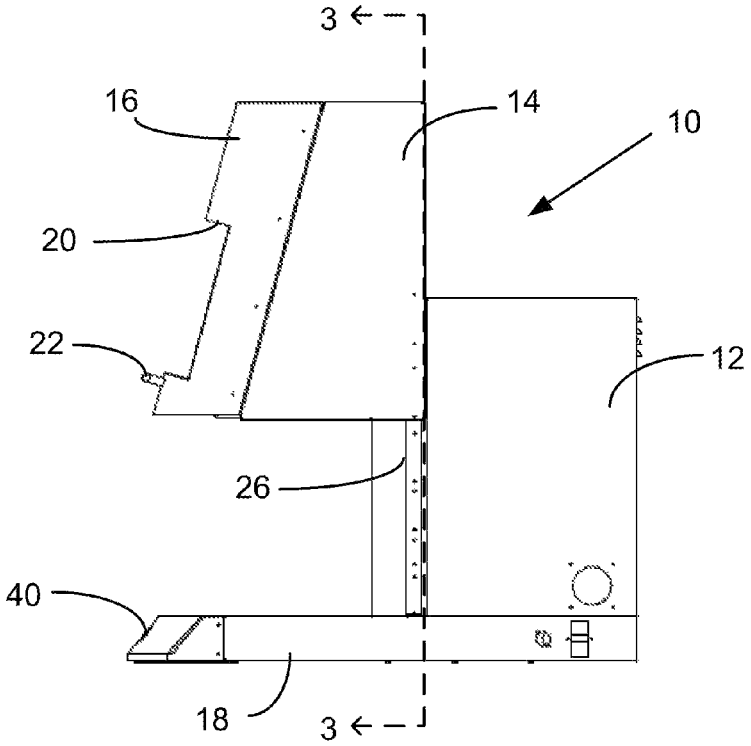
FIG. 2 is a side view, similar to FIG. 1 but with the automatic door in the open position and the manual door portion in the closed position relative to the automatic door.
Figure 4:
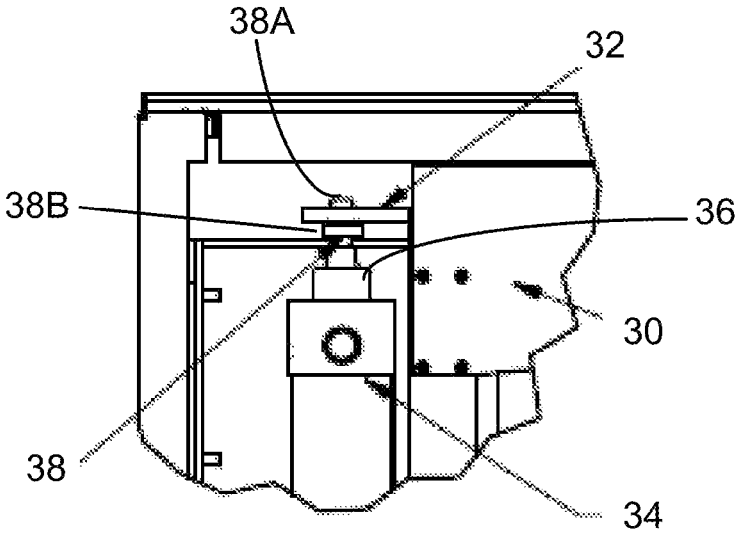
FIG. 4 is a broken-away enlarged view of detail 4 of FIG. 3.

FIGS. 1 and 2 show a laser engraving device 10 having an automatic door 14, a manual door 16, and a base 18. The enclosure 12 of the laser engraving device 10 is secured to the base 18 and encloses the laser (not shown). The automatic door 14 may be raised and lowered relative to the base 18 on which it is mounted, and the manual door 16 may be raised and lowered relative to the automatic door 14, to which it is mounted. The automatic door 14 is raised and lowered by means of a powered linear actuator 34, which, in this embodiment, is a piston/cylinder arrangement (See FIG. 3), as explained in more detail later. Other powered linear actuators are known and could be used instead of the piston/cylinder arrangement, if desired.

The manual door 16 includes a window 20, to allow viewing of the inside of the enclosure 12 when the manual door 16 is closed, and a handle 22 to enable the user to manually raise and lower the manual door 16 relative to the automatic door 14 by guiding the manual door 16 along left and right parallel tracks 24 at the front edge of the automatic door 14. The tracks 24 are mounted onto the front edge of the automatic door 14 and, in this embodiment, the tracks 24 and the front edge of the automatic door 14 are tilted at an acute angle β relative to the base 18. To raise the manual door 16, the user grabs the handle 22 with his hand and raises the manual door 16 against the force of gravity, which is acting to lower the door 16. If desired, the manual door 16 may have spring reels to assist in opening, which would make the manual door 16 function as being very light weight.

There is a rubber seal on the bottom edges of the automatic door 14 and the manual door 16 to ensure that no laser light escapes the closed enclosure 12 along the bottom edge of the doors 14, 16 when they are in the fully closed position.

To close the manual door 16, the user may hold the handle 22 and push downwardly to control the rate at which the manual door 16 travels downwardly relative to the automatic door 14, guided by the tracks 24. In the event that an obstacle blocks the manual door 16 as it is being lowered, the user simply releases the handle 22, and the door 16 will stop.

Since the manual door 16 is relatively lightweight, it will put very little force on the obstacle. The obstacle can then be removed, and the manual door 16 can be guided manually downwardly until it reaches the base 18 (if the automatic door 14 is closed) or until it reaches a stop at the lower edge of the track 24 (if the automatic door 14 is open). In this embodiment, there are rollers 17 (shown in Phantom in FIG. 1) mounted adjacent to the inner surface and rear edge of the manual door by means of pins 19 that extend through the door 16 and provide an axis for rotation for their respective rollers 17. These rollers 17 rotate about their pins 19 as they roll along their respective track 24 on the front edge of the automatic door 14 as the manual door 16 is raised and lowered relative to the automatic door 14.

Figure 7:
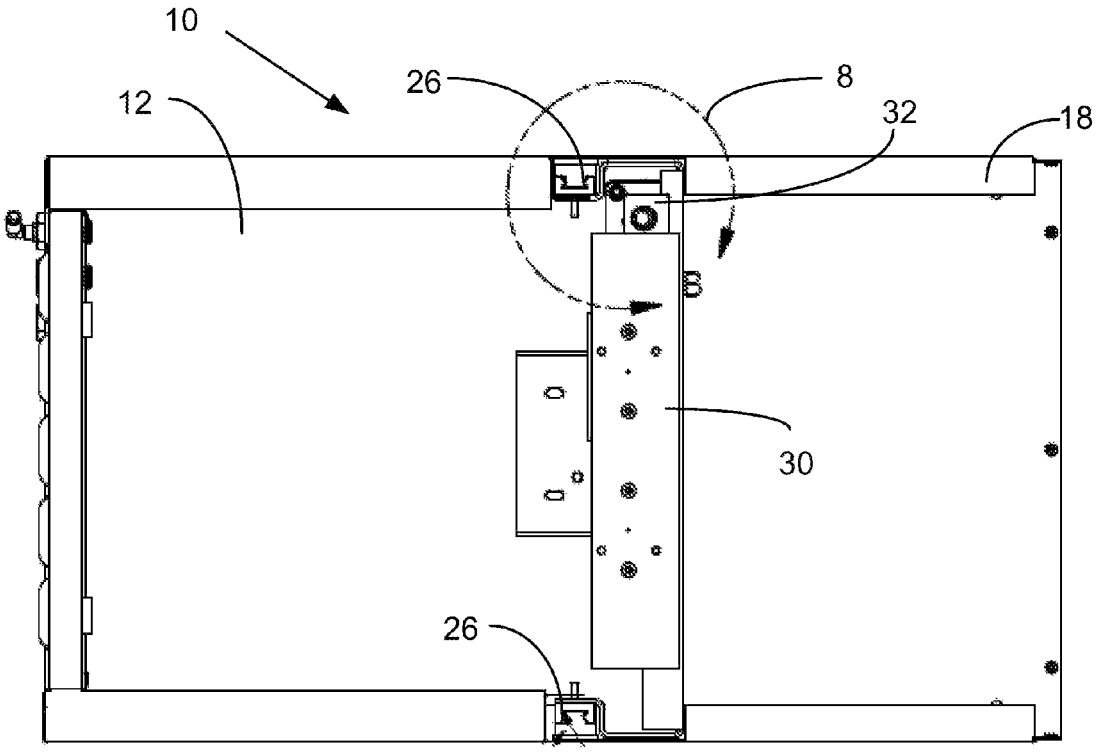
FIG. 7 is a plan view of the enclosure and the door frame, with the door housing and door omitted for clarity.
Figure 8:
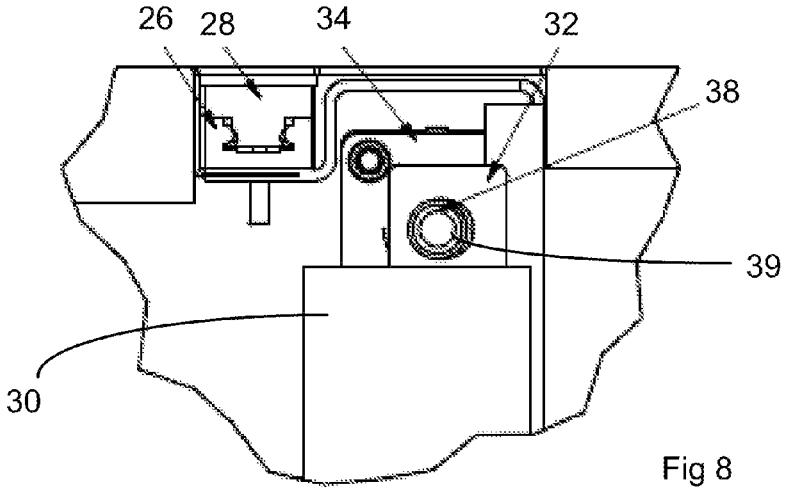
FIG. 8 is a broken-away, enlarged view of detail 8 of FIG. 7.

Referring now to FIG. 2, the automatic door 14 may be raised and lowered relative to the base 18 (and relative to the enclosure 12). The automatic door 14 rides up and down along left and right parallel guide rails 26 (See also FIGS. 7 and 8) mounted onto the enclosure 12. Bearings 28 are used to facilitate the rolling of the automatic door 14 up and down along the guide rails 26. A door housing attachment bracket 30 (See FIGS. 3-8) is bolted onto the automatic door 14 near the top. A door housing guide bracket 32 projects laterally from the attachment bracket 30, and is secured to the attachment bracket 30. The guide bracket 32 defines an opening 39.

Referring now to FIGS. 3-6, a powered linear actuator, which, in this case, is a piston/cylinder arrangement, with a pneumatic cylinder 34 and a piston rod 36, is used to open and close the automatic door 14. The cylinder 34 is mounted in a fixed position relative to the base 18, and the piston rod 36 travels up and down relative to the cylinder 34. The piston/cylinder arrangement is user-actuated by pressing a button 40 (See FIG. 2) on the front of the base 18. The cylinder 34 may be operated pneumatically or hydraulically, or the rod 36 may be mounted on a screw-type electrically-operated linear actuator, or other linear actuator.

The first end of the rod 36 is inside the cylinder 34, and the free end 38 of the rod 36 has a small diameter tip 38A, which extends through the opening 39 in the guide bracket 32, and a larger diameter base 38B, which is larger in diameter than the opening 39, and which abuts the bottom of the guide bracket 32.

As the rod 36 moves upwardly, the base 38B at the free end 38 of the rod 36 pushes up against the bottom surface of the guide bracket 32, lifting the automatic door 14. It should be noted that the free end 38 of the rod 36 is not attached to the guide bracket 32. The small diameter tip 38A is received in the opening 39, and the larger diameter base 38B abuts and pushes up against the bottom of the guide bracket 32 as the rod 36 travels upwardly. The smaller diameter tip 38A of the free end 38 of the rod 36 extends through the opening 39 (See FIG. 8) in the guide bracket 32 to help center the rod 36 on the guide bracket 32, while the larger diameter base 38B of the free end 38 abuts and pushes up against the bottom surface of the guide bracket 32 to lift the automatic door 14.

To close the automatic door 14, the user again presses the button 40, which reverses the direction of travel of the rod 36. The controller (not shown) ensures that the manual door 16 is lowered relative to the automatic door 14 before it will permit the rod 36 to begin travelling downwardly to close the automatic door 14. The free end 38 of the rod 36, travels downwardly with the rod 36, and the automatic door 14, which rests on the larger diameter base 38B, falls downwardly due to the force of gravity, but it falls at a controlled rate, being supported by the free end 38 of the rod 36. When the rod 36 is fully retracted, the automatic door 14 reaches its fully closed position shown in FIGS. 1, 3, and 4.

Figure 6:
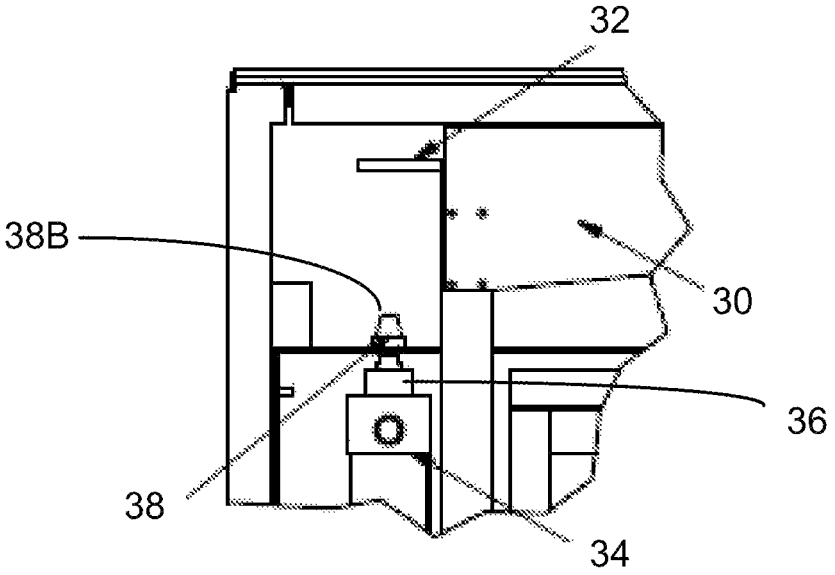
FIG. 6 is a broken-away enlarged view of detail 6 of FIG. 5.
Figure 5:
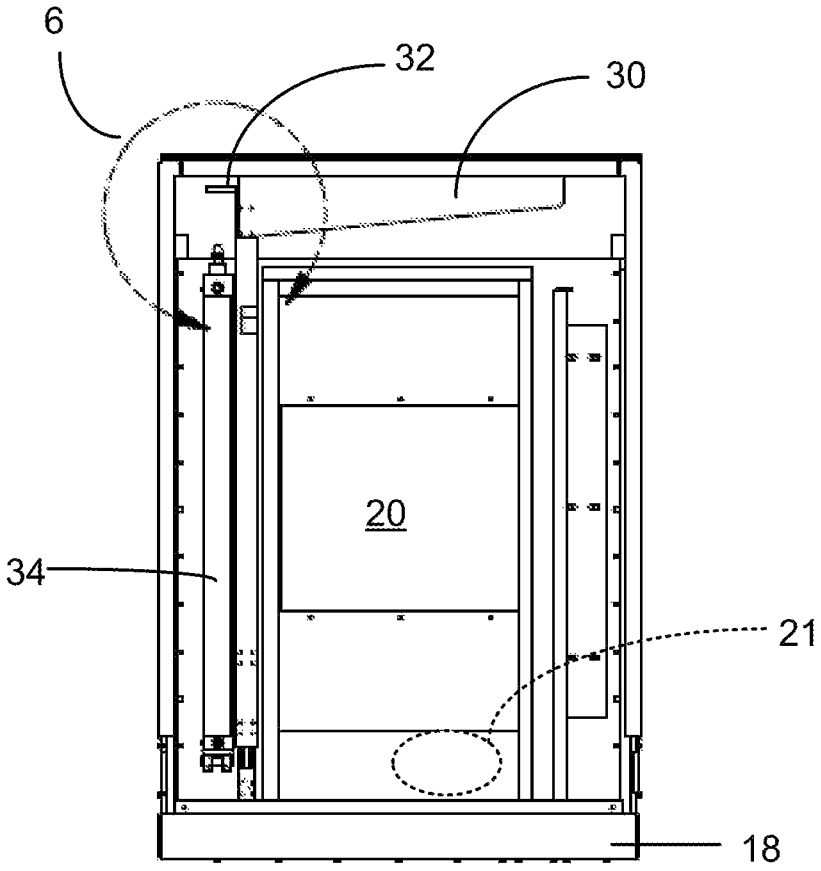
FIG. 5 is the same view as FIG. 3 (but when the automatic door is stopped short of the closed position due to an obstacle), with the actuator rod disengaged from the door guide bracket.

Should an obstacle 21 obstruct the automatic door 14 as the rod 36 is travelling downwardly, as shown in FIG. 5, the rod 36 continues to travel downwardly. Since the door 14 is stopped by the obstacle 21, the rod 36 separates from the guide bracket 32 without pulling down on the automatic door 14, as best shown in FIGS. 5 and 6. The automatic door 14 remains at the elevation where it was stopped by the obstruction, while the rod 36 continues to travel downwardly, separating the free end 38 of the rod 36 from the guide bracket 32, so that the powered rod 36 does not exert any force on the obstacle 21.

Since the powered rod 36 only supports the weight of the automatic door 14 and does not pull the door 14 downwardly, the powered rod 36 does not exert any downward force on the obstruction that might damage the door or the obstruction. Since the door 14 is lightweight, it does not exert enough force to harm a person's hand, arm, or other obstruction 21.

When the obstruction 21 is removed, the automatic door 14 can be allowed to fall downwardly, guided in the left and right tracks 26, until its bottom edge reaches the base 18.

The controller for the laser engraving device 10 checks sensors (not shown) to ensure that the automatic door 14 and manual door 16 are in the fully closed position, with their bottom edges contacting the base 18, before allowing the laser to be activated.

FIG. 1 shows the manual door 16 in the fully open position relative to the automatic door 14, and the automatic door 16 in the fully closed position.

FIG. 2 shows the manual door 16 in the fully closed position relative to the automatic door 14 and the automatic door 14 in the fully open position.

Figure 3:
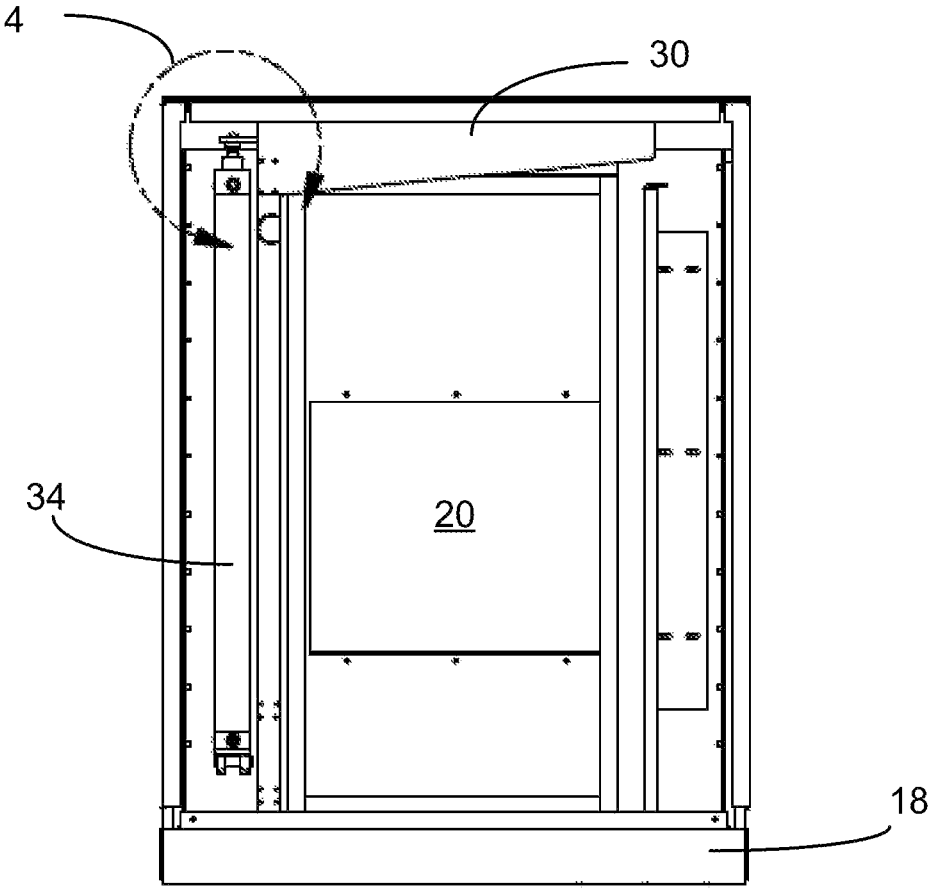
FIG. 3 is a section view along line 3-3 of FIG. 2 (but when the automatic door and manual door are in the substantially closed position), with the actuator rod engaging the door guide bracket.

It will be understood that the automatic door could be in the fully open position of FIG. 2 with the manual door 16 in the fully open position of FIG. 1 relative to the automatic door 14, and the automatic door 14 could be in the fully closed position of FIG. 1 with the manual door 16 in the fully closed position of FIG. 2 relative to the automatic door 14, as in FIG. 3. The controller checks to ensure that both the automatic door 14 and the manual door 16 are in the fully closed position before turning on the laser.

It will be obvious to those skilled in the art that modifications may be made to the embodiments described herein without departing from the scope of the present invention as claimed. For example, the manual door 16 could be eliminated, with the front and sides of the automatic door 14 being fixed together or made in a single piece, which would move as a single unit, to completely enclose the front opening of the enclosure 12.

What is claimed is:

1. A laser engraving device, comprising:

an enclosure housing defining an interior and an exterior and a front opening;

a base;

an automatic door which defines a closed position, in which said automatic door encloses said front opening and rests on said base, and an open position, in which said automatic door is separated away from said base and opens at least a portion of said front opening to the exterior;

a powered linear actuator including a rod having an upper, extended position and a lower, retracted position, said automatic door resting on said rod without being secured to said rod, so that moving said rod from the lower, retracted position to the upper, extended position moves said automatic door to the open position, and moving said rod from the upper, extended position to the lower, retracted position allows said automatic door to fall in a controlled manner, with the automatic door resting on said rod as the automatic door falls from the open position to the closed position, and wherein, if the automatic door encounters an obstruction while falling, the rod will continue to retract and will separate from the automatic door so that the rod will not exert any force on the obstruction.

2. A laser engraving device as recited in claim 1, and further comprising a manual door mounted on said automatic door, said manual door enclosing an opening in said automatic door, and said manual door being manually movable to open and close the opening in the automatic door.

3. A laser engraving device as recited in claim 2, and further comprising a controller for the laser engraving device, wherein said controller ensures that the automatic door and the manual door are in the closed position before allowing the laser to be activated.

4. A laser engraving device as recited in claim 1, wherein said linear actuator is a piston-cylinder arrangement, and said rod is a piston rod having a first end housed in a cylinder and a free end projecting from said cylinder, said piston rod being extendable from and retractable into said cylinder, wherein said automatic doors rests on the free end of said piston rod.

5. A laser engraving device as recited in claim 4, and further comprising a door housing guide bracket connected to said automatic door, wherein said free end of said piston rod supports, but is not secured to, said door housing guide bracket.

6. A laser engraving device as recited in claim 5, wherein said door housing guide bracket defines a bracket opening having an opening diameter, and wherein said free end of said piston rod defines a large diameter base and a smaller diameter tip, wherein said smaller diameter tip extends into said bracket opening to help center the piston rod on the guide bracket, and said larger diameter base abuts and supports said guide bracket.

* * * * *